US006707246B1

(12) United States Patent
Van Den Bogert et al.

(10) Patent No.: US 6,707,246 B1
(45) Date of Patent: Mar. 16, 2004

(54) LOW-PRESSURE MERCURY VAPOR DISCHARGE LAMP WITH IMPROVED AUXILIARY AMALGAM

(75) Inventors: Willem Johannes Van Den Bogert, Eindhoven (NL); Hindrik Hermannus Stel, Eindhoven (NL); Johannes Theodorus Jacobus Van Haastrecht, Roosendaal (NL); Jeroen Jan Wits, Eindhoven (NL); Ronald Arjan Van Den Brakel, Terneuzen (NL); Pieter Cornelis Ooms, Terneuzen (NL); Cornelis De Putter, Terneuzen (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 202 days.

(21) Appl. No.: 09/640,735

(22) Filed: Aug. 17, 2000

(30) Foreign Application Priority Data

Aug. 19, 1999 (EP) ..... 99202689
Jun. 27, 2000 (EP) ..... 00202246

(51) Int. Cl.[7] ..... H01J 61/28

(52) U.S. Cl. ..... 313/490; 313/552; 313/565; 313/564; 313/566

(58) Field of Search ..... 313/490–493, 313/565, 564, 566, 550, 552, 556

(56) References Cited

U.S. PATENT DOCUMENTS 3,548,241 A * 12/1970 Rasch et al. ..... 313/566
3,562,571 A * 2/1971 Evans et al. ..... 313/490
3,629,641 A * 12/1971 Hofmann et al. ..... 313/490
3,688,148 A * 8/1972 Fedorenko et al. ..... 313/490
3,858,075 A * 12/1974 Herrmann et al. ..... 313/490
4,047,071 A * 9/1977 Busch et al. ..... 252/181.6
4,182,971 A * 1/1980 Cassidy et al. ..... 313/546
4,542,319 A * 9/1985 Grenfell et al. ..... 313/326
5,204,584 A 4/1993 Ikeda et al. ..... 313/565
5,394,056 A * 2/1995 Forman et al. ..... 313/490

FOREIGN PATENT DOCUMENTS

DE 2027893 12/1970 ..... H01J/61/24
JP 01186544 A * 7/1989 ..... H01J/61/28

* cited by examiner

*Primary Examiner*—Ashok Patel
*Assistant Examiner*—Sikha Roy
(74) *Attorney, Agent, or Firm*—Ernestine C. Bartlett

(57) ABSTRACT

A low-pressure mercury vapor discharge lamp is provided with a discharge vessel (10). The discharge vessel comprises tubular end portions (11; 11'), which each have a longitudinal axis (12; 12'). The discharge vessel (10) encloses a discharge space (18) containing a filling of mercury and an inert gas in a gastight manner. Electrodes (20; 20') are arranged in the discharge space (18). An auxiliary amalgam is provided on a carrier (25; 25') in the proximity of the electrodes (20; 20'). According to the invention, a part of the carrier (25; 25') is arranged in a plane transverse to the longitudinal axis (12; 12'). Preferably, a stem (21; 21') in the tubular end portion (11; 11') carries, apart from the electrode (20; 20'), a support in the form of a wire (23; 23') or an extended exhaust tube, which support carries the carrier (25; 25'). In an alternative embodiment, the carrier is clamped directly onto the stem. Preferably, the carrier (25; 25') is electrically insulated with respect to the electrode. Preferably, a distance d between the carrier (25; 25') and the electrode (20; 20') lies in the range $1 \leqq d \leqq 3$ mm. According to the invention, the discharge lamp has a relatively short run-up time.

15 Claims, 5 Drawing Sheets

LOW-PRESSURE MERCURY VAPOR DISCHARGE LAMP WITH IMPROVED AUXILIARY AMALGAM

BACKGROUND OF THE INVENTION

The invention relates to a low-pressure mercury vapor discharge lamp comprising a discharge vessel, which discharge vessel encloses a discharge space containing a filling of mercury and an inert gas in a gastight manner, and said discharge vessel (10) comprising tubular end portions, which each have a longitudinal axis, electrodes being arranged in the discharge space for generating and maintaining a discharge in the discharge space, and at least an auxiliary amalgam being provided on a carrier in the discharge vessel in the proximity of at least one of the electrodes.

In mercury vapor discharge lamps, mercury constitutes the primary component for (efficiently) generating ultraviolet (UV) light. An inner surface of the discharge vessel may be coated with a luminescent layer comprising a luminescent material (for example a fluorescent powder) for the conversion of UV to other wavelengths, for example to UV-B and UV-A for tanning purposes (sunbed lamps) or to visible radiation for general lighting purposes. As a result, such discharge lamps are also referred to as fluorescent lamps. The discharge vessel of low pressure mercury vapor discharge lamps generally is tubular in shape with a circular cross-section and comprises both elongated and compact embodiments. In general, the tubular discharge vessel of so-called compact fluorescent lamps comprises a collection of relatively short straight parts having a relatively small diameter, which straight parts are connected to each other, on the one hand, by means of bridge parts and/or, on the other hand, by means of curved parts. Compact fluorescent lamps are generally provided with an (integrated) lamp cap.

In the description and the claims of the current invention, the designation "nominal operation" is used to indicate operating conditions where the mercury vapor pressure is such that the radiant efficacy of the lamp is at least 80% of that during optimum operation, i.e. operating conditions where the mercury vapor pressure is optimal. Furthermore, in the description and the claims, the "initial radiant efficacy" is defined as the radiant efficacy of the discharge lamp 1 second after switching on the discharge lamp, and the "run-up time" is defined as the time required by the discharge lamp to reach a radiant efficacy of 80% of that during optimum operation.

A low-pressure mercury vapor discharge lamp as mentioned in the opening paragraph is known from U.S. Pat. No. 5,204,584. Said known low-pressure mercury vapor discharge lamp comprises a suitable combination of a main amalgam and an auxiliary amalgam, the latter being provided on one of the current supply conductors which extend from the electrodes through a so-called stem in the tubular end portion and, subsequently, issue from the discharge vessel to the exterior. In this known lamp the main amalgam is dosed so that it controls the mercury vapor pressure discharge space except for the starting period. FIG. 5 shows this known lamp, having a main amalgam 131 and auxiliary amalgams 133 and 135.

In general, a low-pressure mercury vapor discharge lamp containing an auxiliary amalgam with sufficient mercury has a relatively short run-up time. Upon switching on the lamp, the auxiliary amalgam is heated by the electrode, so that the auxiliary amalgam relatively rapidly delivers a substantial part of the mercury it contains. It is desirable that, prior to switching on the lamp, said lamp has been out of operation for a sufficiently long time to enable the auxiliary amalgam to absorb sufficient mercury. If the lamp has been out of operation for a relatively short period of time, the run-up time reduction is only small and, in addition, the initial radiant efficacy is (even) lower than that of a lamp comprising only a main amalgam because the auxiliary amalgam sets the mercury vapor pressure in the discharge space at a relatively lower value. In addition, relatively long lamps exhibit the drawback that relatively much time goes by before the mercury delivered by the auxiliary amalgam has spread throughout the discharge vessel, so that after switching on such lamps there is a relatively bright zone near the auxiliary amalgam and a relatively dark zone at some distance from the auxiliary amalgam, which zones last a few minutes.

A drawback of the known low-pressure mercury vapor discharge lamp resides in that the run-up time is relatively long in spite of the application of an auxiliary amalgam.

SUMMARY OF THE INVENTION

It is an object of the invention to provide a lamp of the type described in the opening paragraph which, when regularly used, has a relatively short run-up time. To achieve this, the low-pressure mercury vapor discharge lamp is characterized in accordance with the invention in that a part of the carrier is arranged in a plane transverse to the longitudinal axis.

As a result of the fact that said part of the carrier is arranged in a plane transverse to the longitudinal axis, the auxiliary amalgam is better irradiated by the heat generated in the electrode when the low-pressure mercury vapor discharge lamp is started. As a result, relatively more mercury is loosened relatively more rapidly from the auxiliary amalgam upon starting the discharge lamp. By virtue of the measure in accordance with the invention, the run-up time of the low-pressure mercury vapor discharge lamp is relatively short. In low-pressure mercury vapor discharge lamps, the electrode is generally arranged transversely to the longitudinal axis.

In the known discharge lamp, the auxiliary amalgam is provided on one of the current supply conductors, which extend from the electrodes through a so-called stem in the tubular end portion and, subsequently, issue from the discharge vessel to the exterior. As a result, the auxiliary amalgam is arranged so as to be parallel to the longitudinal axis, thus rendering the auxiliary amalgam relatively insensitive to radiant heat emitted by the electrodes upon starting the low-pressure mercury vapor discharge lamp.

Relative to the known discharge lamp, the auxiliary amalgam in the low-pressure mercury vapor discharge lamp in accordance with the invention is provided so as to be rotated through 90° as it were, so that the major part of the carrier is positioned so as to extend parallel to the electrode. Without being obliged to give any theoretical explanation, the inventors hold the opinion that the reduction of the run-up time is caused by the fact that a part of the mercury, which is loosened from the auxiliary amalgam on the carrier, travels more toward the interior of the discharge vessel of the low-pressure mercury vapor discharge lamp. As a result, in a short period of time after starting the discharge lamp, the back diffusion of mercury to the cold locations at the side of the electrodes facing away from the discharge space takes longer than in the known lamp. By virtue thereof, more mercury is available at locations in the discharge space which heat up relatively rapidly, thereby giving rise to an improved run-up behavior.

An embodiment of the low-pressure mercury vapor discharge lamp is characterized in accordance with the invention in that a stem in the tubular end portion carries the electrode, and in that the stem comprises a supporting body on which the carrier is provided. As will be explained in greater detail hereinbelow, the supporting body is formed by an extended exhaust tube or by a supporting wire provided in the stem. In an alternative modification, the carrier is provided directly on the stem. In the known discharge lamp, the auxiliary amalgam is provided on one of the current supply conductors, which extend from the electrodes through a so-called stem in the tubular end portion and, subsequently, issue from the discharge vessel to the exterior. Particularly in so-called cold-start low-pressure mercury vapor discharge lamps, this causes material to be sputtered off the auxiliary amalgam and deposited on the tubular end portions of the discharge vessel. Without being obliged to give any theoretical explanation, the inventors hold the opinion that the above problem is caused by the cold ignition of the discharge lamp, whereby, shortly after starting the lamp, the discharge acts on the (still) cold emitter and on the auxiliary amalgam, resulting in a discharge on the emitter and on the auxiliary amalgam. The discharge on the auxiliary amalgam causes the amalgam to be sputtered off the carrier and gives rise to blackening of the tubular end portions and a poor run-up behavior. Sputtering as well as blackening are undesirable phenomena. Furthermore, the service life of the lamp is reduced if any amalgam originating from the auxiliary amalgam lands on the electrode. The effect is enhanced by the relatively high cathode drop which is characteristic of cold-ignition low-pressure mercury vapor discharge lamps.

In a preferred embodiment of the low-pressure mercury vapor discharge lamp in accordance with the invention, the carrier is arranged at a side of the electrode facing away from the discharge space. In this embodiment, the carrier is situated between the stem and the electrode. By virtue thereof, a simple construction is obtained having a relatively short supporting wire supporting the carrier.

In an alternative, favorable embodiment of the low-pressure mercury vapor discharge lamp in accordance with the invention, the carrier is electrically insulated with respect to the electrode. As the carrier with the auxiliary amalgam is electrically insulated from the current supply conductor connected to the electrode, said auxiliary amalgam is at the same potential as its surroundings and will not attract ions present in the discharge. As a result, the run-up behavior of the discharge lamp is improved and blackening of the tubular end portions of the low-pressure mercury vapor discharge lamp is substantially precluded. The auxiliary amalgam on the carrier is heated by the discharge in a manner comparable to that in induction lamps.

These and other aspects of the invention will be apparent from and elucidated with reference to the embodiments described hereinafter.

DETAILED DESCRIPTION OF THE PREFERRED EMBODIMENTS

Figure 1:
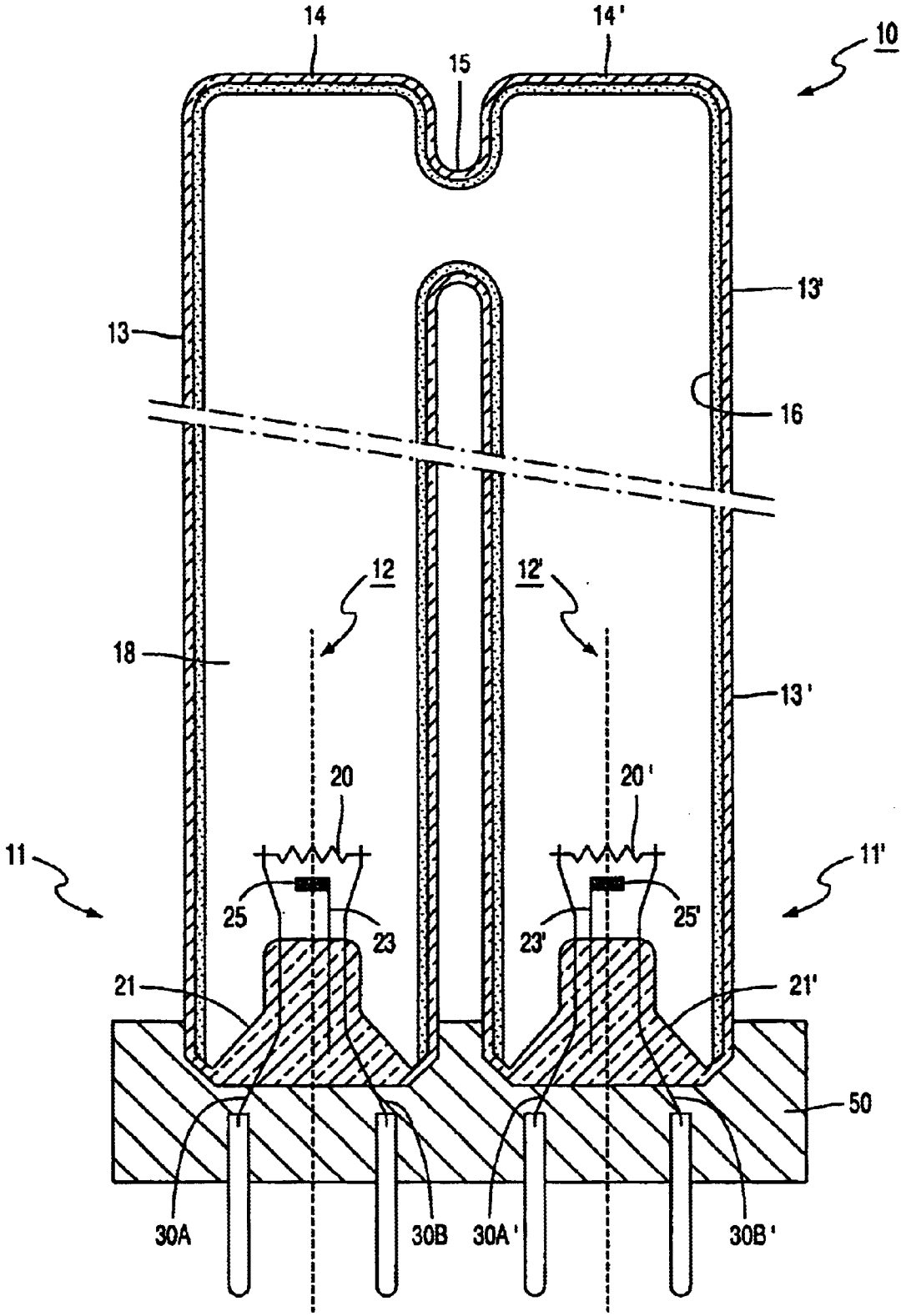
FIG. 1 is a cross-sectional view of a first embodiment of the low-pressure mercury vapor discharge lamp in accordance with the invention.

The Figures are purely diagrammatic and not draw to scale. Particularly for clarity, some dimensions are exaggerated strongly. In the Figures, like reference numerals refer to like parts whenever possible.

FIG. 1 shows a first embodiment of a low-pressure mercury vapor discharge lamp in accordance with the invention, which is provided with a (glass) discharge vessel 10 having tubular end portions 11; 11'. The discharge vessel 10 encloses, in a gastight manner, a discharge space 18 containing an ionizable filling comprising less than 3 mg mercury and an inert gas, for example a 75/25 mixture of argon and neon. In the embodiment shown, the discharge vessel 10 comprises two tube portions 13; 13' each having a tubular end portion 11; 11' with a longitudinal axis 12; 12'. The end portions 11; 11' are jointly fixed in a lamp cap 50, which is shown very diagrammatically. In an alternative embodiment, a so-called integrated lamp cap is employed wherein a copper-iron ballast or an electronic gear control is situated, and which lamp cap is further provided with, for example, so-called E14 or E27 connection means. At tube ends 14; 14' situated opposite to the lamp cap 50, the tube portions 13; 13' are in communication with each other via a channel 15. The discharge vessel may alternatively be embodied so as to be a single elongated or (multiple-) bent tube, for example a tube bent in the form of a hook. The discharge vessel 10 is provided, at a side facing the discharge space 18, with a luminescent layer 16. In each end portion 11; 11', an electrode 20; 20' is arranged on a so-called stem 21, 21' in the discharge space 18. The electrode 20; 20' is preferably arranged transversely to the longitudinal axis. In an alternative embodiment of the low-pressure mercury vapor discharge lamp, the electrode is axially mounted in the end portion. In addition, in a further alternative embodiment of the low-pressure mercury vapor discharge lamp, an external electrode may be provided at an end portion of the discharge vessel to bring about a capacitive coupling with a lamp power supply. Current supply conductors 30A, 30B; 30A', 30B' extend from the electrodes 20, 20' through the stem 21; 21' in the end portion 11; 11' and issue from the discharge vessel 10 to the exterior. At least one stem 21; 21' carries an auxiliary amalgam (not shown in FIG. 1) which is provided on a carrier 25; 25', which carrier 25; 25' is provided in the stem 21; 21' by means of a supporting wire 23; 23'. In the embodiment shown, both stems 21; 21' carry an auxiliary amalgam. In accordance with the invention, (a part of) the carrier 25; 25' is arranged in a plane transverse to the longitudinal axis 12; 12'.

Figure 2:
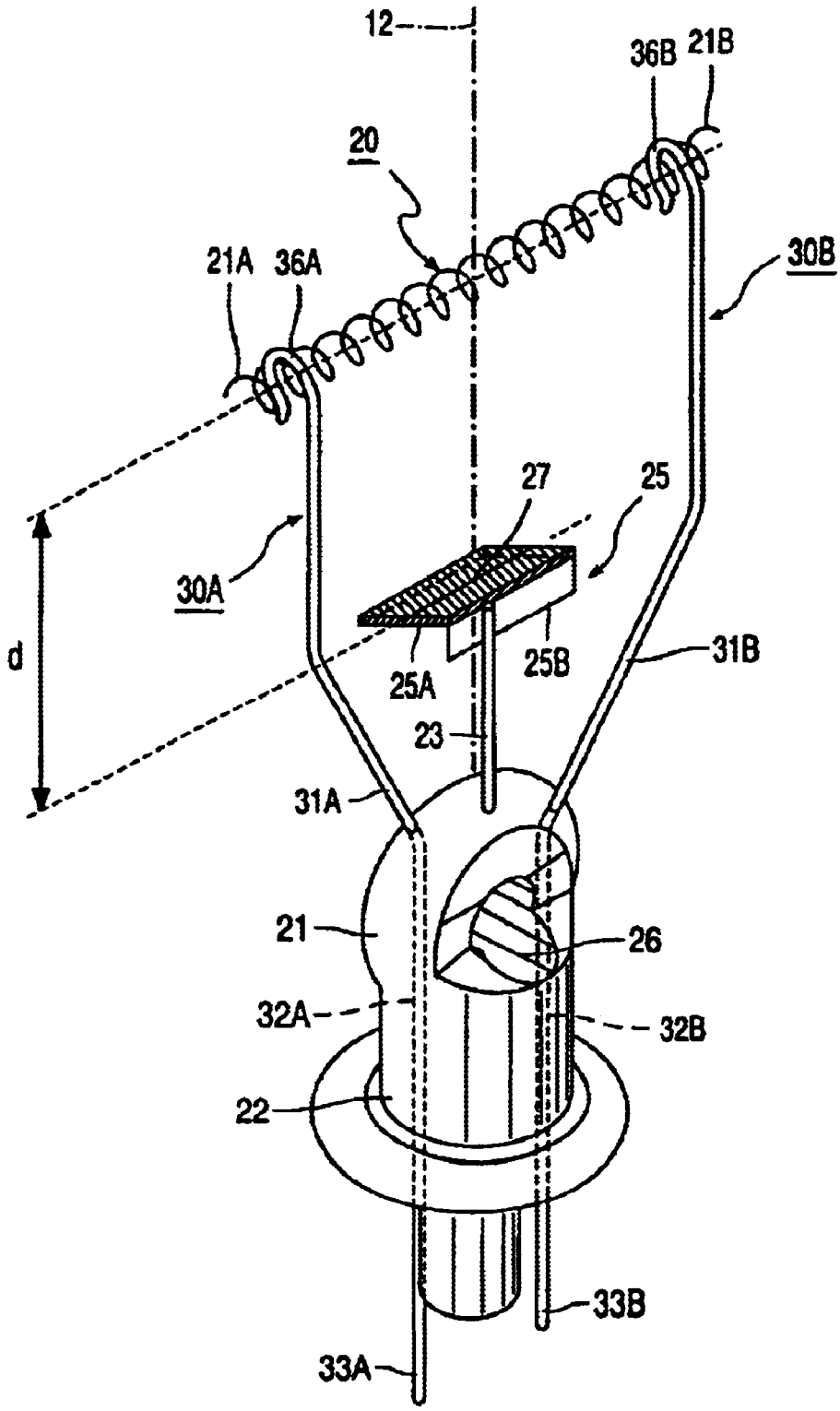
FIG. 2 is a perspective view of a detail of the discharge lamp shown in FIG. 1, FIG. 3 and FIG. 4 are perspective views of a corresponding detail of, respectively, a second and a third embodiment of the low-pressure mercury-vapor discharge lamp in accordance with the invention.

FIG. 2 is a perspective view of a detail of the discharge lamp shown in FIG. 1. The auxiliary amalgam 27, in this example lead-tin-mercury, is provided on a part 25A of the carrier 25. This part 25A of the carrier 25 is arranged, in accordance with the invention, in a plane transverse to the longitudinal axis 12. In the example shown in FIG. 2, the carrier 25 comprises a further part 25B which is arranged in a plane parallel to the longitudinal axis 12. The supporting wire 23 is attached to this further part 25B, which supporting wire is anchored in the stem 21. In the example shown in FIG. 2, the supporting wire 23 in the stem 21 is symmetrically placed with respect to the current supply conductors 30A, 30B. In an alternative embodiment, the supporting wire is asymmetrically arranged with respect to the current supply conductors (FIG. 1). The carrier 25, 25' may be in the form of a plate and/or comprises, preferably, a network of mesh-woven wire on which the auxiliary amalgam is deposited. In an alternative embodiment, the carrier 25; 25' of the auxiliary amalgam is made from a dense piece of strip material wherein small cuts are made, whereafter the strip is stretched so as to form an open structure. The parts 25A and 25B of the carrier are very diagrammatically shown, and both parts 25A and 25B may be covered with the auxiliary amalgam Preferably, only the part 25A, which extends transversely to the longitudinal axis 12 and parallel to the electrode 20, is provided with the auxiliary amalgam 27. In the example shown in FIG. 1 and FIG. 2, the carrier 25; 25' is arranged at a side of the electrode 20; 20' facing away from the discharge space 18. In this embodiment, the carrier is situated between the stem 21; 21' and the electrode 20; 20'. In this manner, a simple construction is obtained having a relatively short supporting wire 23; 23' which supports the carrier 25; 25'.

In an alternative embodiment, the carrier is arranged in the discharge space at a side of the electrode facing away from the stem in the tubular end portion of the discharge lamp. In this embodiment, the auxiliary amalgam is placed in the discharge in a similar manner as auxiliary amalgams in electrode less discharge lamps, which are also referred to as induction lamps.

Figure 3:
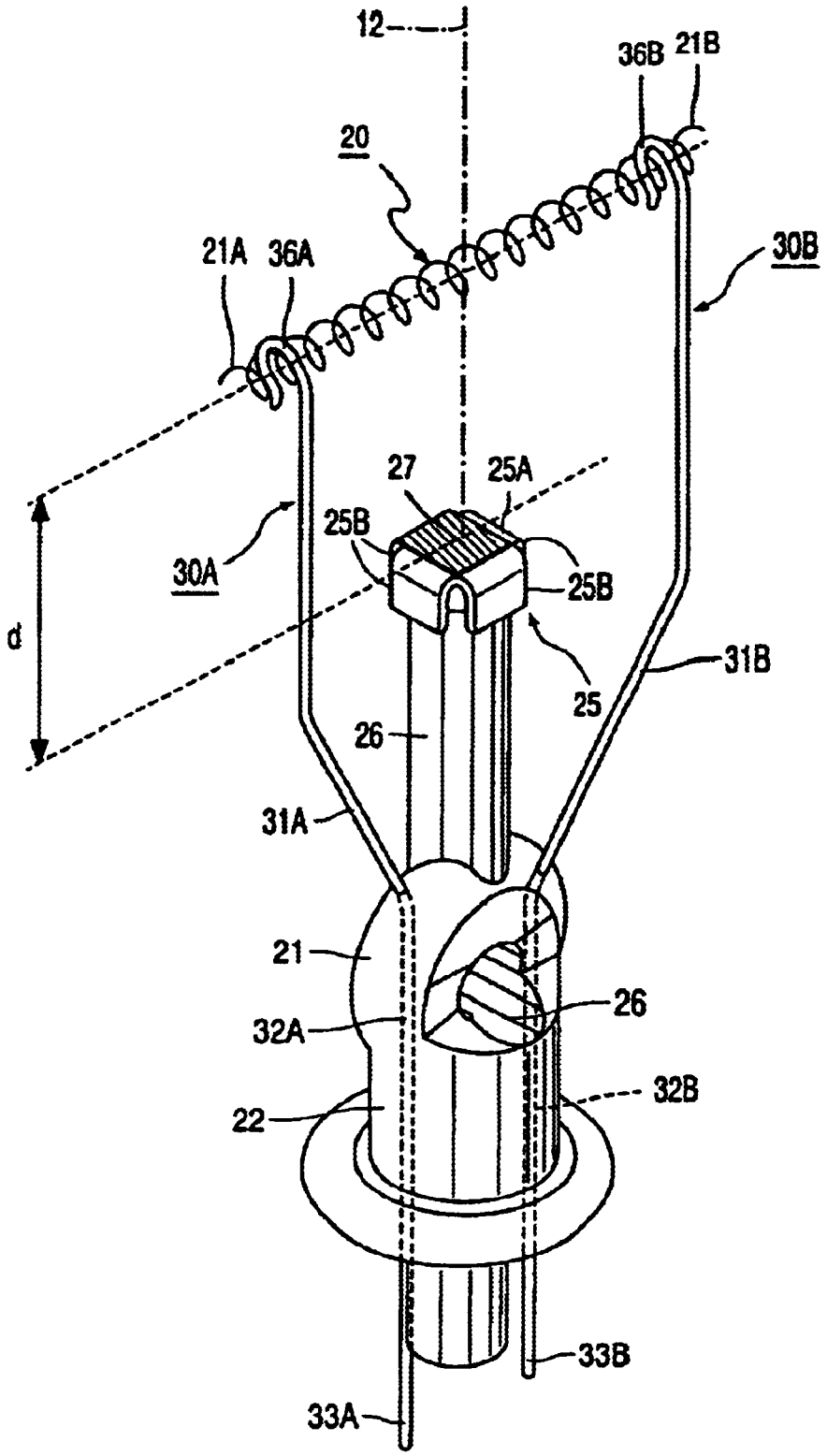
Figure 4:
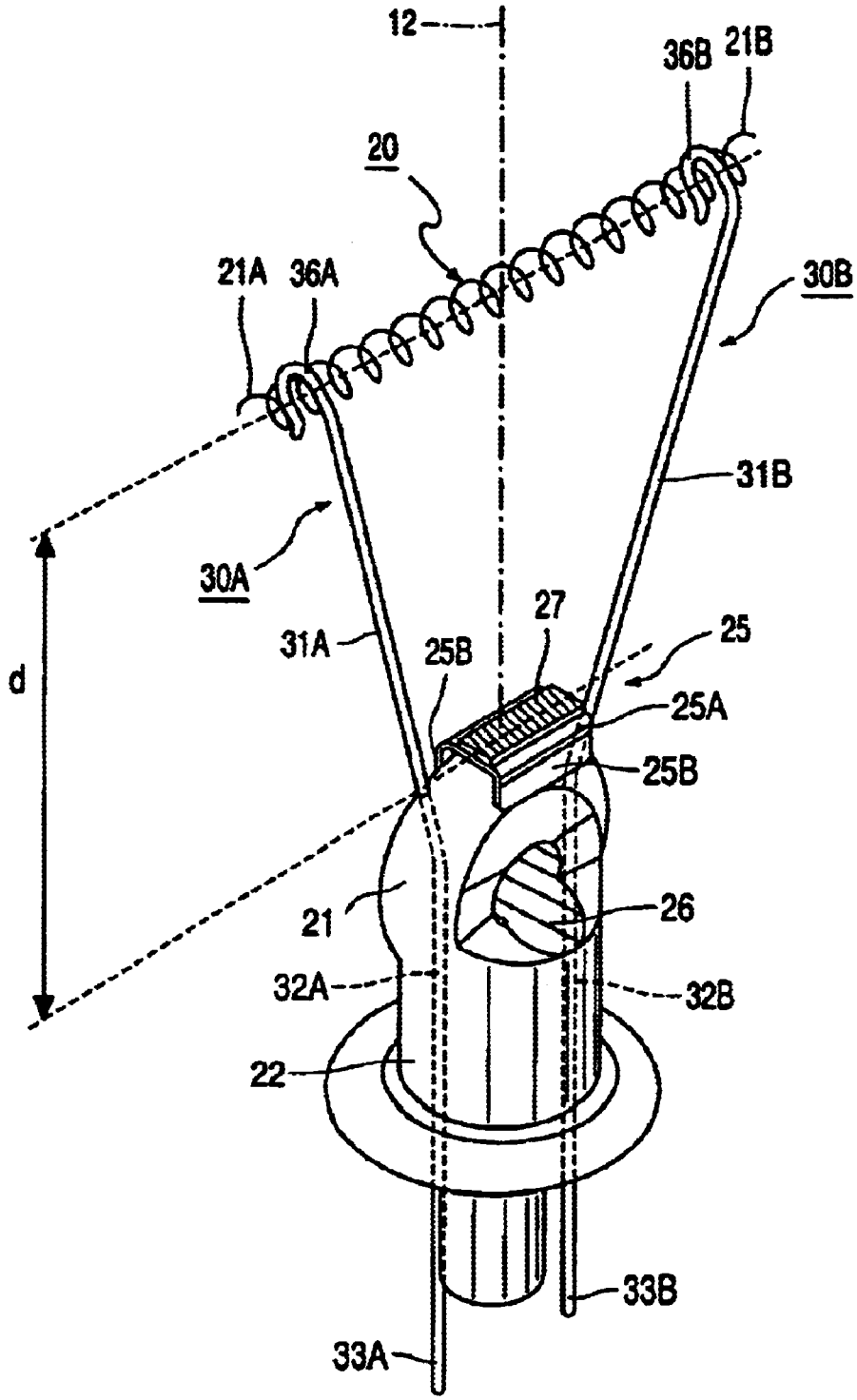
Figure 5:
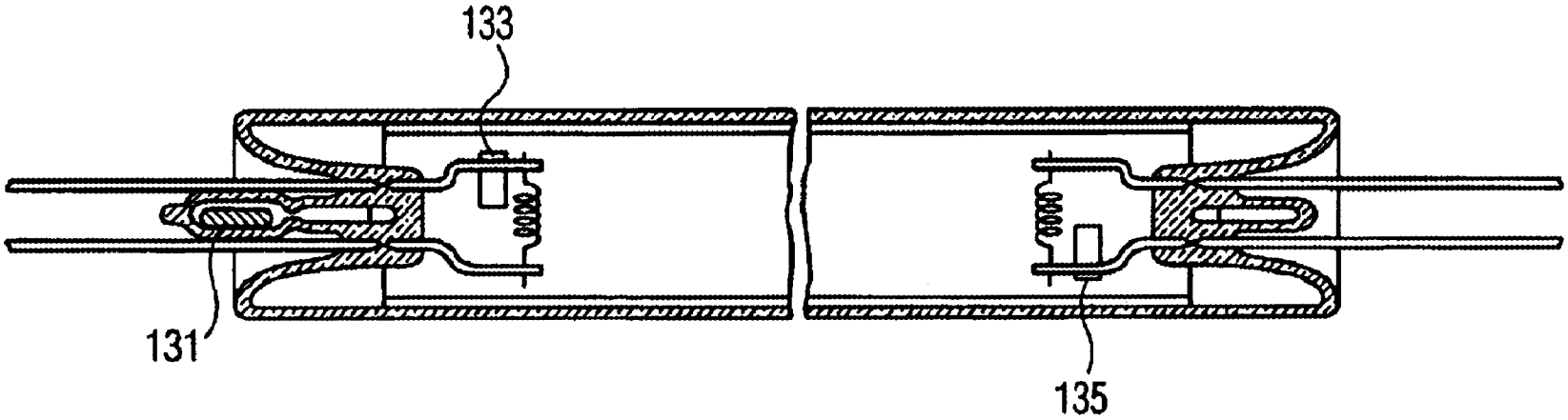
FIG. 5 PRIOR ART
FIG. 5 is a cross-sectional view of a known lamp having a main amalgam and auxiliary amalgams.

FIG. 3 relates to a perspective view which corresponds to that shown in FIG. 2, and corresponding parts bear the same reference numerals. In FIG. 3, the supporting body is not formed by the supporting wire 23, 23' provided in the stem 21, 21', but by an exhaust tube 26 which extends at least partly in the discharge space 18 almost up to the electrodes 20, 20'. The carrier 25, 25' with the amalgam is clamped on to the end of the exhaust tube 26 extending between the current-supply conductors 30A, 30B. In this case, the carrier 25, 25' comprises four wing-shaped portions which are bent around the end portion of the extended exhaust tube 26 so as to be a tight fit thereon, thereby forming a portion 25A which extends in a plane transverse to the longitudinal axis 12 and four portions 25B which extend in a plane parallel thereto. As shown in FIG. 4, in an alternative embodiment the carrier 25, 25' can be directly provided on the stem 21, 21' so as to be a tight fit thereon, for example by means of pinching. This is achieved in the same manner as described with respect to the embodiment of FIG. 3 by bending, in this case two, wing-shaped portions of the carrier 25, 25' around the stem 21, 21' so as to be a tight fit thereon, whereby, also in this case, a portion 25A extending in a plane transverse to the longitudinal axis 12 and, in this case, two portions 25B extending in a plane parallel to said axis are formed.

It will be clear to those of ordinary skill in the art that, to provide the quick release of mercy described above, the significant property of the arrangement is that the auxiliary amalgam extends in both orthogonal directions in the plane transverse to the longitudinal axis 12, and be close to the electrode. Therefore at least a portion of the carrier on which the auxiliary amalgam exists is aligned, parallel to the longitudinal axis of the end portion, with the nearby electrode. As a result the auxiliary is effectively irradiated by the heat generated in the electrode when the lamp is started.

The particular advantage of the modifications as shown in FIGS. 3 and 4 is that in both cases the carrier 25, 25' can be provided so as to be a tight fit after the stem 21, 21' has been brought to a desired cooling temperature in a controlled process using a heating arrangement wherein said stem is accommodated, said cooling operation being carried to preclude stresses in the glass due to (too) rapid cooling in the temperature range below 1000° C. This is advantageous, in particular, because the auxiliary amalgam 27 on the carrier 25, 25' cannot withstand said high temperatures.

In FIGS. 2, 3 and 4, the current supply conductors 30A, 30B comprise a first segment 31A, 31B of iron wire having a thickness of 0.6 mm, a second segment 32A, 32B of NiFeCuMn wire having a thickness of 0.35 mm, and a third segment 33A, 33B of CuSn wire having a thickness of 0.4 mm, which segments extend substantially, respectively, in the discharge vessel 10, in a wall 22 of the stem 21, and outside the discharge vessel 10 (see FIGS. 2, 3 and 4 wherein the second segments 32A, 32B are represented by means of dashed lines). At the end portion 11', the lamp is similarly constructed (not shown in FIGS. 2, 3 and 4).

The electrode 20; 20' is a winding of tungsten which is covered with an electron-emitting substance, in this case a mixture of barium oxide, calcium oxide and strontium oxide. The electrode 20; 20' comprises a winding which is clamped at both ends 21A, 21B in a bend 36A, 36B of a current supply conductor 30A, 30B, respectively.

In the embodiments shown in FIGS. 2, 3 and 4, both end portions 11, 11' of the discharge vessel 10 comprise an auxiliary amalgam 27 which is provided on a carrier 25; 25' which is connected to the stem 21; 21' via a supporting wire 23; 23' (FIG. 2), on an extended exhaust tube 26 (FIG. 3) or directly on the stem 21, 21' (FIG. 4). For clarity, the construction of the end portions is not shown in detail in FIG. 1.

In FIGS. 2, 3 and 4, the auxiliary amalgam 27 is situated at a distance d from the electrode 20; 20', where d>0. The distance d is measured, as is shown in FIGS. 2, 3 and 4, from the surface of the amalgam 27 to the center of the electrode 20; 20'. In accordance with a favorable embodiment of the invention, the distance d meets the relation:

$$0.5 \leqq d \leqq 8 \text{ mm.}$$

A particularly suitable value of the distance d is $1 \leqq d \leqq 3$ mm. In this manner, a compact discharge lamp is obtained.

Known low-pressure mercury vapor discharge lamps, wherein the auxiliary amalgam is provided on one of the current supply conductors extending parallel to the longitudinal axis of the tubular end portion, and low-pressure mercury. vapor discharge lamps in accordance with the invention, wherein an auxiliary amalgam is provided on a carrier, and said auxiliary amalgam is arranged substantially parallel to the electrode, and the carrier is electrically insulate with respect to the current supply conductors, are subjected to life tests. All tests are carried out using so-called PLE-T 20 Watt at a rated voltage of 230 V (at a mains voltage of 50 Hz). The switching cycle is such that the lamp is alternately 1 minute in the on-state and 3 minutes in the off-state, the lamps burning in the so-called "base-up" position for 8 hours; the switch-off time was 16 hours. At zero, 1000, 2000 and 3000 switching operations, the run-up time was measured for eight lamps of each series. The time necessary to reach the rated light intensity of the discharge lamp is expressed by means of the so-called "run-up" time, which describes the time period within which the discharge lamp reaches 80% of its maximum light output. Table I shows the results. Also the standard deviations of the run-up times are listed in the Table.

TABLE I

| | Run-up time | |
|---|---|---|
| | Run-up time (s) | |
| number of switching operations | known discharge lamp: auxiliary amalgam on current supply conductor | discharge lamp in accordance with the invention: auxiliary amalgam on an electrically insulated carrier parallel to the electrode |
| 0 | 177 ± 13 | 112 ± 27 |
| 1000 | 168 ± 8 | 105 ± 27 |
| 2000 | 174 ± 18 | 95 ± 29 |
| 3000 | 162 ± 39 | 106 ± 25 |

The known discharge lamps exhibit a much longer run-up time than the discharge lamps in accordance with the invention. By virtue of the measure in accordance with the invention, a low-pressure mercury vapor discharge lamp of the type described in the opening paragraph is provided which reaches its rated light intensity more rapidly. By electrically insulating the auxiliary amalgam with respect to the current supply conductors, blackening on the tubular end portion of cold-start low-pressure mercury vapor discharge lamps in accordance with the invention is effectively precluded.

It will be clear that, within the scope of the invention, many variations are possible to those skilled in the art.

The scope of protection of the invention is not limited to the above examples. The invention is embodied in each novel characteristic and each combination of characteristics. Reference numerals in the claims do not limit the scope of protection thereof. The use of the verb "to comprise" and its conjugations does not exclude the presence of elements or steps other than those stated in the claims. The use of the article "a" or "an" preceding an element does not exclude the presence of a plurality of such elements.

What is claimed is:

1. A low-pressure mercury vapor discharge lamp comprising a discharge vessel (10), said discharge vessel (10) enclosing a discharge space (18) containing a filling of mercury and an inert gas in a gastight manner, and said discharge vessel (10) comprising:

tubular end portions (11; 11'), which each have a longitudinal axis (12; 12'), electrodes (20; 20') arranged in the discharge space (18) for generating and maintaining a discharge in the discharge space (18), a main amalgam disposed for controlling the mercury pressure in the discharge space except for a starting period, and at least an auxiliary amalgam (27) provided on a carrier (25; 25') in one of said tubular end portions of the discharge vessel (10) in the proximity of at least one of the electrodes (20; 20'), characterized in that the carrier (25; 25') is supported on a body formed of electrically insulating material extending in said one of said tubular end portions and is electrically insulated with respect to the electrode (20; 20'), at least a major part (25A) of the carrier (25; 25') is arranged in a plane transverse to the longitudinal axis (12; 12'), and the auxiliary amalgam extends substantially in two mutually orthogonal directions, substantially planar and transverse to said longitudinal axis, and is disposed substantially in line with said at least one of the electrodes in a direction parallel with said longitudinal axis, whereby during the starting period the lamp has a relatively short run-up time.

2. A low-pressure mercury vapor discharge lamp as claimed in claim 1, wherein said body is a stem (21; 21') in the tubular end portion (11; 11'), said stem carries the electrode (20; 20'), and the carrier (25; 25') is provided on a supporting body arranged in the stem (21; 21').

3. A low-pressure mercury vapor discharge lamp as claimed in claim 2, wherein the supporting body is formed by a wire (23, 23').

4. A low-pressure mercury vapor discharge lamp as claimed in claim 1, wherein the carrier (25; 25') is arranged at a side of the electrode (20; 20') facing away from the discharge space (18).

5. A low-pressure mercury vapor discharge lamp as claimed in claim 1, wherein the carrier (25; 25') comprises a further part (25B) which is arranged in a plane parallel to the longitudinal axis (12; 12').

6. A low-pressure mercury vapor discharge lamp as claimed in claim 1, wherein a distance d between the carrier (25; 25') and the electrode (20; 20') lies in the range from $0.5<d<8$ mm.

7. A low-pressure mercury vapor discharge lamp comprising a discharge vessel (10), said discharge vessel (10) enclosing a discharge space (18) containing a filling of mercury and an inert gas in a gastight manner, and said discharge vessel (10) comprising:

tubular end portions (11; 11'), which each have a longitudinal axis (12; 12'), electrodes (20; 20') arranged in the discharge space (18) for generating and maintaining a discharge in the discharge space (18), a main amalgam disposed for controlling the mercury pressure in the discharge space except for a starting period, and at least an auxiliary amalgam (27) provided on a carrier (25; 25') in one of said tubular end portions of the discharge vessel (10) in the proximity of at least one of the electrodes (20; 20'), characterized in that the carrier (25; 25') is supported on a body formed of electrically insulating material extending in said one of said tubular end portions and is electrically insulated with respect to the electrode (20; 20'), at least a major part (25A) of the carrier (25; 25') is arranged in a plane transverse to the longitudinal axis (12; 12'), the auxiliary amalgam extends substantially in two mutually orthogonal directions, substantially planar and transverse to said longitudinal axis, and is disposed substantially in line with said at least one of the electrodes in a direction parallel with said longitudinal axis, and a distance d between the carrier (25; 25') and the electrode (20; 20') lies in the range from $1<d<3$ mm, whereby during the starting period the lamp has a relatively short run-up time.

8. A low-pressure mercury vapor discharge lamp as claimed in claim 1, wherein the said body is a stem (21, 21') which carries the electrode (20, 20') in the tubular end portion (11, 11'), and the carrier (25; 25') is directly press-fitted onto said stem.

9. A low-pressure mercury vapor discharge lamp comprising a discharge vessel (10), said discharge vessel (10) enclosing a discharge space (18) containing a filling of mercury and an inert gas in a gastight manner, and said discharge vessel (10) comprising:

tubular end portions (11; 11'), which each have a longitudinal axis (12; 12'), electrodes (20; 20') arranged in the discharge space (18) for generating and maintaining a discharge in the discharge space (18), and, in addition to said filling of mercury and inert gas, at least an auxiliary amalgam (27) provided on a carrier (25; 25') in the discharge vessel (10) in the proximity of at least one of the electrodes (20; 20'), characterized in that at least a part (25A) of the carrier (25; 25') is arranged in a plane transverse to the longitudinal axis (12; 12'), the auxiliary amalgam extends substantially in two orthogonal directions transverse to said longitudinal axis, and is disposed substantially in line with said at least one of the electrodes in a direction parallel with said longitudinal axis, and the carrier is provided on an external surface of a supporting body formed by an exhaust tube (26) which extends at least partially into the discharge space (18).

10. A low-pressure mercury vapor discharge lamp as claimed in claim 9, wherein said exhaust tube (26) has an end portion which is situated in the discharge space, and is electrically insulated with respect to the electrode (20; 20'), and the carrier (25; 25') is clamped onto the end portion of the exhaust tube (26).

11. A low-pressure mercury vapor discharge lamp as claimed in claim 10, wherein the carrier (25; 25') comprises a further part (25B) which is arranged in a plane parallel to the longitudinal axis (12; 12').

12. A low-pressure mercury vapor discharge lamp as claimed in claim 10, wherein a distance d between the carrier (25; 25') and the electrode (20; 20') lies in the range from $1<d<3$ mm.

13. A low-pressure mercury vapor discharge lamp as claimed in claim 10, wherein the carrier (25; 25') comprises a further part (25B) which is arranged in a plane parallel to the longitudinal axis (12; 12'), said further part clamping the carrier onto said end portion.

14. A low-pressure mercury vapor discharge lamp as claimed in claim 13, wherein a distance d between the carrier (25; 25') and the electrode (20; 20') lies in the range from $0.5<d<8$ mm.

15. A low-pressure mercury vapor discharge lamp as claimed in claim 13, wherein a distance d between the carrier (25; 25') and the electrode (20; 20') lies in the range from $1<d<3$ mm.

* * * * *